US006634635B2

(12) United States Patent
Kaya et al.

(10) Patent No.: US 6,634,635 B2
(45) Date of Patent: Oct. 21, 2003

(54) LIFT HOOK FOR A SHEET SEPARATING DEVICE

(75) Inventors: Mehmet Oktay Kaya, Lee, NH (US); Heiner Philipp Luxem, Durham, NH (US); Peter John Banks, Maidenhead (GB); Anthony Philip Broadbent, Dalton (GB)

(73) Assignee: Heidelberger Druckmaschinen AG, Heidelberg (DE)

( * ) Notice: Subject to any disclaimer, the term of this patent is extended or adjusted under 35 U.S.C. 154(b) by 91 days.

(21) Appl. No.: 09/886,635

(22) Filed: Jun. 21, 2001

(65) Prior Publication Data

US 2002/0101018 A1 Aug. 1, 2002

Related U.S. Application Data

(60) Provisional application No. 60/265,253, filed on Jan. 31, 2001.

(51) Int. Cl.[7] ..... B65H 3/14

(52) U.S. Cl. ..... 271/97; 271/98; 271/100; 271/106; 271/111

(58) Field of Search ..... 271/97, 98, 100, 271/106, 111

(56) References Cited

U.S. PATENT DOCUMENTS

| | | | | | |
|---|---|---|---|---|---|
| 3,586,316 | A | * | 6/1971 | Ehlscheid et al. | 271/98 |
| 3,988,016 | A | | 10/1976 | Merker et al. | 270/55 |
| 4,157,692 | A | | 6/1979 | Brocklehurst et al. | 112/262.3 |
| 4,369,962 | A | * | 1/1983 | Spiro | 271/98 |
| 5,984,622 | A | * | 11/1999 | Schum et al. | 271/97 |
| 6,015,145 | A | * | 1/2000 | Hartel | 271/106 |
| 6,206,361 | B1 | * | 3/2001 | Geldmeier | 271/98 |
| 6,345,818 | B1 | * | 2/2002 | Stephan et al. | 271/106 |

FOREIGN PATENT DOCUMENTS

JP 05310334 A * 11/1993 ..... B65H/3/08

* cited by examiner

*Primary Examiner*—Eileen D. Lillis
*Assistant Examiner*—Michael Lowe
(74) *Attorney, Agent, or Firm*—Davidson, Davidson & Kappel, LLC

(57) ABSTRACT

An apparatus for separating a flat product from a pile of flat products set operators comprising a lift hook being movable from a closing position to an opening position. The lift hook supports the bottom of a pile of flat products in its closing position and includes an air channel for supplying air through said channel. Alternatively, a separate air tube may be provided.

18 Claims, 2 Drawing Sheets

LIFT HOOK FOR A SHEET SEPARATING DEVICE

This is a non-provisional application claiming priority to Provisional Application No. 60/265,253 filed Jan. 31, 2001 which is hereby incorporated by reference herein.

BACKGROUND OF THE INVENTION

1. Field of the Invention

The present invention relates generally to apparatus for separating flat products from a pile of flat products, and in particular to an apparatus for separating flat products from a pile of flat products, the apparatus including a lift hook movable from a closing position to an opening position wherein the lift hook supports the bottom of a pile of flat products in its closing position and includes an air channel for applying air through the channel.

2. Background Information

In the technology of building books, including booklets, magazines, periodicals, and the like, the use of collating systems is well known. These systems typically have a transporting device on which individual flat products, such as signatures or sheets, are gathered to build a book-block set, which then is finished and bound. Typically, a number of feeders are arranged along the transporting device, each of the hoppers including a feeding mechanism for feeding an individual flat product from a pile of signatures onto the transporting device, in order to gradually build up the book-block set or to insert a supplement sheet into a pocket of a pocket feeder or into a newspaper arranged in the pocket. Such feeding mechanisms typically employ a sheet-separating device for separating a sheet or other single flat product from a pile of flat products which is arranged in each hopper. The single flat products are drawn from the pile at its bottom end.

A sheet-separating device of this kind is described, for example, in U.S. Pat. No. 3,988,016. This document describes a high-speed paper inserting apparatus for insertion of supplements into newspapers. The inserts are placed to form a stack and a vacuum gripping member grips the lowermost insert from the stack and carries it to a pair of nip rollers which transport the insert to an opened newspaper. A single sheet requires a different sucker stroke than a 120-page or pre-inserted section. The different sucker motion requirements are due to the way the sheets or sections have to be positioned and controlled for proper singulation.

Generally, the bottom of the stack is supported by a platform, a so-called signature table having a recess for allowing a sucker to draw a single product from the lowermost end of the pile of products. When the sucker does not contact the pile of products the pile is supported by a movable hook, as shown in U.S. Pat. No. 4,157,692.

These known sheet separating devices however suffer from the disadvantage that during working, especially with thin clumsy signatures, double-pulling or bowing may occur which may lead to a stop of the machine.

SUMMARY OF THE INVENTION

It is an object of the present invention to provide a sheet-separating device having an improved lift hook. It is also an object of the present invention to provide an improved separation process of the lowermost product of the pile of products associated with a sheet-separating device.

The present invention provides an apparatus for separating flat products from a pile of flat products, the apparatus including a lift hook movable from a closing position to an opening position and supporting the bottom of a pile of flat products in its closing position wherein the lift hook defines an air channel therein for supplying air through the channel.

The air may be supplied to the air channel continuously or at timed intervals.

The air supplied to the air channel may exit the air channel at an outlet opposite a bottom of the pile of flat products so as to project one or more air streams from the lift hook.

The present invention also provides an apparatus for separating flat products from a pile of flat products, the apparatus including a lift hook movable from a closing position to an opening position and supporting the bottom of a pile of flat products in its closing position; and an air tube for supplying air to an outlet opposite a bottom of the pile of flat products so as to project at least one air stream therefrom.

The one or more air streams may act to support the pile of flat products.

The one or more air streams may act to support the bottommost product at a sucker adapted to draw a bottommost product of the pile of products from the pile.

The one or more air streams may act to help separate a bottommost product from the pile of products as the bottommost product is being drawn from the pile by a sucker.

The one or more air streams may include a first and a second air stream, the first and the second air streams being independently actuatable.

The flat products may include include signatures or sheets.

The present invention also provides a method for separating flat products from a pile of flat products, the method including providing a lift hook movable from a closing position to an opening position and supporting the bottom of a pile of flat products in its closing position, the lift hook defining an air channel therein; and supplying air through the air channel.

The apparatus and method according to the present invention enable improved separation of the bottommost sheet from pile of sheets associated with a sheet-separating device.

BRIEF DESCRIPTION OF THE DRAWINGS

The present invention is elaborated upon below with reference to the accompanying drawings.

DETAILED DESCRIPTION

Figure 1:
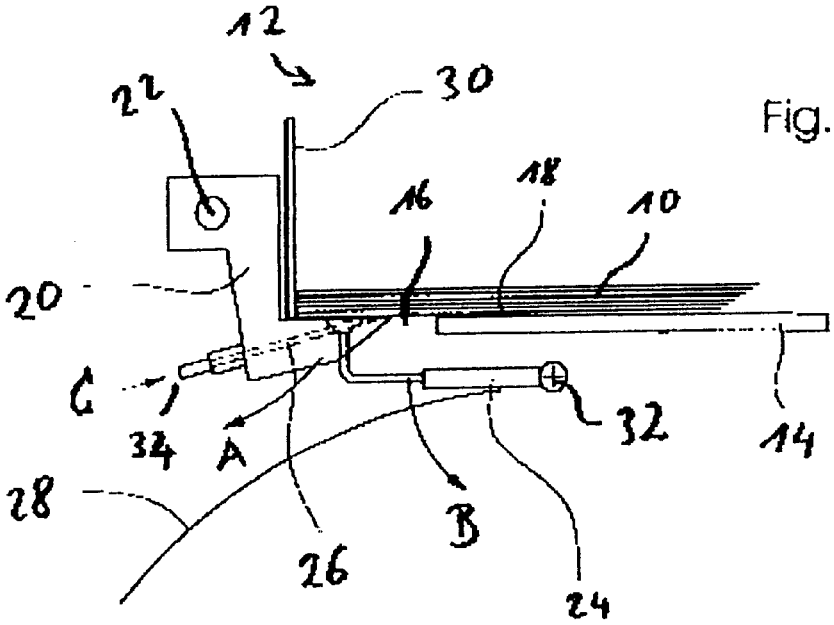
FIG. 1 shows a schematic side view of a sheet-separating device with the lift hook in its closing position.
Figure 2:
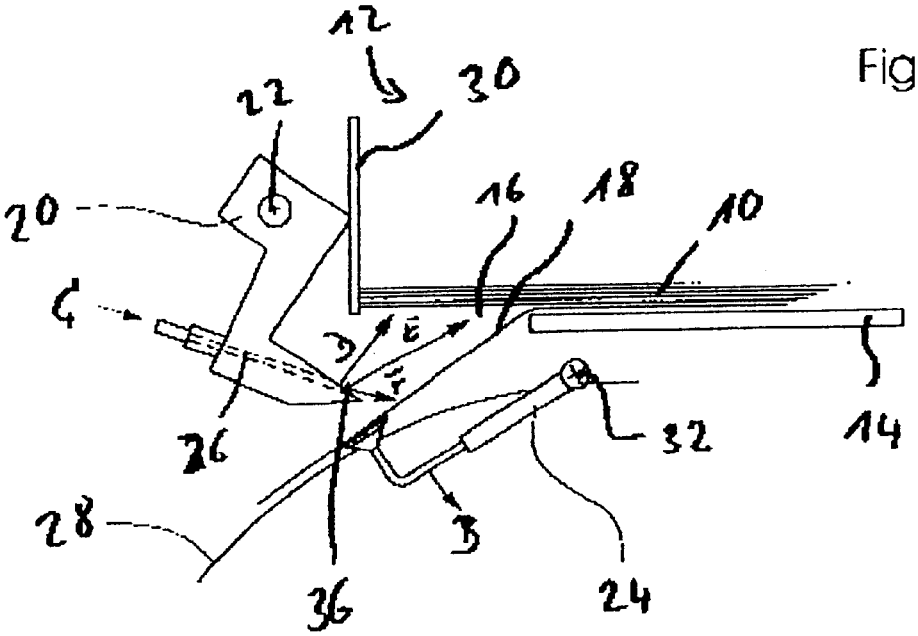
FIG. 2 shows a schematic side view of a sheet-separating device with the lift hook in its opening position.

Referring to FIG. 1, a schematic side view of a sheet-separating apparatus according to the present invention is shown. Pile of flat products 10, especially of sheets or signatures of paper or plastic, is arranged in hopper 12 and lays flat on signature table 14 against front guide 30. In order to be able to draw the bottommost sheet 18 of the pile 10 a gap or recess 16 is provided at the bottommost end of the pile 10. Lift hook 20 supports pile 10 when the lift hook is in its closed position as shown in FIG. 1. Lift hook 20 is movable from a closed position to an opening position (FIG. 2).

Lift hook 20 is preferably rotatably mounted on a pivot point 22. Therefore it is possible to rotate lift hook 20 in the direction given by the arrow A so that sucker 24 can draw down the bottommost signature 18 from pile of signatures 10. For this purpose sucker 24 is rotatably mounted on a sucker pivot point 32 and can be rotated in the direction given by the arrow B. A device such as sucker 24 is generally known and may be any type of suitable device for drawing a vacuum so as to attract a sheet toward it. Lift hook 20 includes air channel 26 where air may be applied through the air channel 26 as indicated by the arrow C. Air channel 26 may be any type of passage or bore in lift hook 20 suitable as a conduit for air therethrough. The air may be applied to the air channel via inlet 34. A sheet-separating apparatus may include more than one such lift hook 20, or a mixture of lift hooks with and without an air channel 26.

When lift hook 20 is in its opening position the air flowing through air channel 26 leaves the air channel at outlet, or nozzle, 36 opposite the bottom of pile 10 and is divided up in a plurality of air streams D, E, F projecting from lift hook 20. Each of air streams D, E, F aids in the operation of separating a single sheet 18 from the pile of sheets 10. As air stream D touches underneath pile 10 air stream D acts as a support for the pile which is to be kept in the hopper. Air stream F, which is directed to the single sheet 18 drawn from pile 10, acts to support single sheet 18 at sucker 24. Air stream E acts to help separate single sheet 18 from pile 10. In other embodiments according to the present invention only one or two of air streams D, E, F may be provided.

Although it is possible to supply a continuous stream of air or gas through air channel 26 of lift hook 20, it is also possible to blow air through the air channel only in timed intervals sequenced to the rhythm of removal of sheets 18 from pile 10. Additionally, in other embodiments according to the present invention air streams D, E, F may independently actuatable, using a valving arrangement for example, to be activated at different or the same time intervals so as to fine-tune their effect on the separation of single sheet 18 from pile 10. Any suitable air supply source, such as a compressor, etc., may be used.

Figure 3:
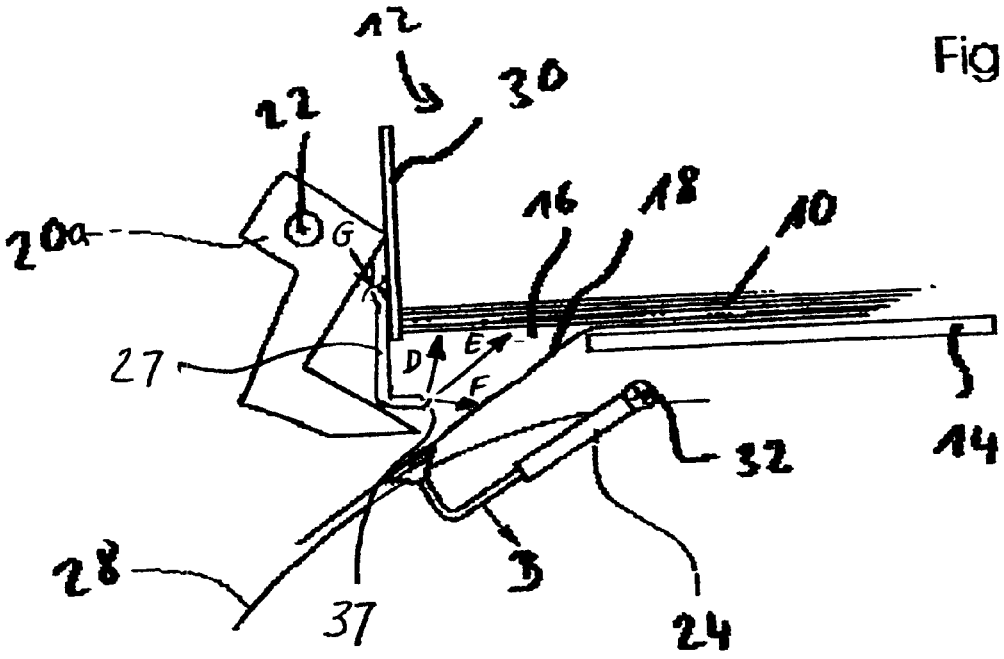
FIG. 3 shows a schematic side view of a sheet-separating device with the lift hook in its opening position and a separately-mounted air nozzle.

Referring now to FIG. 3, in another embodiment according to the present invention lift hook 20*a* having no air channel may be provided. Separate air tube 27 terminated by outlet, or nozzle, 37 is provided, rather than air channel 26 and outlet, or nozzle, 36 in lift hook 20, as described above. Air tube and outlet 37 are mounted independently of lift hook 20*a* and may be stationary or rotatable in concert with lift hook 20*a* or in any suitable fashion. Air tube and outlet 37 may be mounted in any suitable fashion, and on any suitable structure, such as hopper 12, for example. Air may be provided through air tube 27 as indicated by arrow G. Air leaves outlet 37 opposite the bottom of pile 10 and is divided up in a plurality of air streams D1, E1, F1 projecting from lift hook 20. Each of air streams D1, E1, F1 aids in the operation of separating a single sheet 18 from the pile of sheets 10, as with air streams D, E, F described above with reference to FIG. 2. The previous discussion regarding air streams D, E, F and the air supply to channel 26 may apply to the embodiment according to the present invention shown in FIG. 3. In yet other embodiments according to the present invention both a lift hook including an air channel, as well as a separately-mounted air tube, may be provided.

It will of course be understood that the present invention has been described above only by way of example and that modifications of details can be made within the scope of the invention. For example, any suitable shape and mounting of lift hook 20, 20*a* may be employed. Other configurations of sucker 24 are also possible.

What is claimed is:

1. An apparatus for separating flat products from a pile of flat products, the apparatus comprising:

a lift hook movable from a closing position to an opening position and having a surface opposite a bottom of a pile of flat products, the surface supporting the bottom of the pile of flat products in the closing position, wherein the lift hook has an air channel therein for supplying air through the air channel, the air channel having an outlet on the surface opposite the bottom of the pile.

2. The apparatus as recited in claim 1 wherein air is supplied to the air channel continuously.

3. The apparatus as recited in claim 1 wherein air is supplied to the air channel at timed intervals.

4. The apparatus as recited in claim 1 wherein at least one air stream from the outlet acts to support the pile of flat products.

5. The apparatus as recited in claim 1 further comprising a sucker adapted to draw a bottommost product from the pile of flat products from the pile and wherein at least one air stream from the outlet acts to support the bottommost product at the sucker.

6. The apparatus as recited in claim 1 further comprising a sucker and wherein at least one air stream from the outlet acts to help separate a bottommost product from the pile of flat products as the bottommost product is being drawn from the pile by the sucker.

7. The apparatus as recited in claim 1 wherein at least one air stream from the outlet includes a first and a second air stream, the first and the second air streams being independently actuatable.

8. The apparatus as recited in claim 1 wherein the flat products include signatures or sheets.

9. An apparatus for separating flat products from a pile of flat products, the apparatus comprising:

a lift hook movable from a closing position to an opening position and having a surface opposite the bottom of the pile, the surface supporting the bottom of the pile of flat products in the closing position, the surface opposite the bottom having an outlet; and an air inlet for supplying air to the outlet opposite a bottom of the pile of flat products so as to project at least one air stream therefrom.

10. The apparatus as recited in claim 9 wherein the at least one air stream acts to support the pile of flat products.

11. The apparatus as recited in claim 9 further comprising a sucker adapted to draw a bottommost product of the pile of flat products from the pile and wherein the at least one air stream acts to support the bottommost product at the sucker.

12. The apparatus as recited in claim 9 further comprising a sucker and wherein the at least one air stream acts to help separate a bottommost product from the pile of flat products as the bottommost product is being drawn from the pile by the sucker.

13. A method for separating flat products from a pile of flat products, the method comprising:

providing a lift hook moveable from a closing portion to an opening position and having a surface opposite a bottom of a pile of flat products for supporting the bottom of the pile of flat products in the closing position, the lift hook having an air channel therein, the surface opposite the bottom having an outlet; and supplying air through the air channel to the outlet so as to project at least one air stream.

14. The method as recited in claim 13 wherein the supplying is performed at timed intervals.

15. The method as recited in claim 13 wherein the at least one air stream is projected so as to support the pile of flat products.

16. The method as recited in claim 13 wherein the at least one air stream is projected so as to support the bottommost product at a sucker adapted to draw a bottommost product of the pile of flat products from the pile.

17. The method as recited in claim 13 wherein the at least one air stream is projected so as to help separate a bottommost product from the pile of flat products as the bottommost product is being drawn from the pile by a sucker.

18. The method as recited in claim 13 wherein the flat products include signatures or sheets.

* * * * *